United States Patent [19]

Chauvel

[11] Patent Number: 4,684,938

[45] Date of Patent: Aug. 4, 1987

[54] SYSTEM FOR DISPLAYING DATA ON A VIDEO SCREEN IN GRAPHICAL MODE

[75] Inventor: Gerard Chauvel, Cagnes/Mer, France

[73] Assignee: Texas Instruments Incorporated, Dallas, Tex.

[21] Appl. No.: 583,072

[22] Filed: Feb. 23, 1984

[30] Foreign Application Priority Data

Feb. 25, 1983 [FR] France ..... 83 03142
Feb. 25, 1983 [FR] France ..... 83 03144

[51] Int. Cl.[4] ..... G09G 1/16
[52] U.S. Cl. ..... 340/747; 340/802
[58] Field of Search ..... 340/701, 703, 727, 735, 340/745, 747, 748, 750, 802

[56] References Cited

U.S. PATENT DOCUMENTS 4,323,896 4/1982 Fielder et al. ..... 340/802
4,434,488 2/1984 Palmquist et al. ..... 340/802
4,435,779 3/1984 Mayer et al. ..... 340/747
4,503,429 3/1985 Schreiber ..... 340/747

*Primary Examiner*—Gerald L. Brigance
*Assistant Examiner*—Jeffery A. Brier
*Attorney, Agent, or Firm*—Richard K. Robinson; Rodney M. Anderson; Robert D. Marshall, Jr.

[57] ABSTRACT

A system for visualization on a video screen (6) in a graphical mode in which the visual information to be displayed is defined on the screen by a point by point sweeping, from page memory containing, at a given time, all of the video information to be displayed, and a video display processor (4), connected to a random access memory containing said page memory and to a display control unit (37) adapted to convert the information relative to the image composed from the contents of the memory (5) to screen (6) control signals, characterized in that central processing unit (1) is connected to the video display processor (4) by means of a single bus (12) over which are transmitted, on a time shared basis, the address fields and the data fields (15) and in that it includes in addition a control and interpretation circuit (27) capable, in response to an assignment signal generated by said central processing unit, to interpret the address field as an address field per se or as a control field for the video display processor.

21 Claims, 14 Drawing Figures

SYSTEM FOR DISPLAYING DATA ON A VIDEO SCREEN IN GRAPHICAL MODE

This invention relates to visualization systems for video screen display in a graphic mode, by frame sweeping, line by line and point by point, based on binary data with the image being composed in advance in a random access, or page, memory.

Such a system generally includes a composite memory, a portion being a page memory, a central processing unit controlling the memory, the display elements themselves, the input peripherals for the data to be displayed, and a video processor which executes certain image processing functions, and also serves to adapt the processing speeds of various peripherals to those of the central processing unit.

A drawback of conventional systems consists in that the speed of image composition depends upon the processing speed of the central processor, which latter is relatively slow.

In arrangements utilizing microprocessors as the central processing unit, the access to the read only memory containing the programm, or the random access memory containing the data, is effected by means of two distinct buses, one for the data fields, and the other for the address fields. A control bus carries the signals for accessing the memory (enablement, reading, writing, etc). This known architecture has a major drawback especially when a sixteen bit data bus is used and there is an address field greater than 64K words, as the number of "pins" of the central processing unit becomes very high (greater than 40 for example).

Advances in integration technology as to speed and density provided for improvements in the access methods to memories external the central unit, so as to diminish the number of "pins" of the integrated circuits making up these units.

It has, therefore, been recently possible to utilize not two buses for circulating the data and addresses, but a single bus on which travels the data and address fields in time multiplexing, wherein each cycle of the external memory corresponds to the operation on an address field, and then a data field, by means of control signals generated in the central processing unit.

The object of the invention is to utilize this new technology in order to increase the processing speed of the image composition signals and to relieve the central processing unit of some tasks so that the unit will be made free and can handle other tasks, which can be effected simultaneously.

The invention has, therefore, as an object a system of visualization on a video screen in a graphical mode in which the visual information to be displayed is defined on the screen by the point by point sweeping of a frame, the information being from a page memory containing all of the video information to be displayed at a given moment, this system including a central processing unit connected to one or more receiver peripherals for the video information to be displayed, and also connected to a video display processor, which is itself connected to a random access memory containing said page memory, and also connected to a display control unit for converting the information regarding the image prepared from the memory into control signals for the screen characterized in that the central processing unit is connected to the video display processor by means of a single bus over which travel in time sharing the address fields and the data fields.

The invention is described below in greater detail with reference to the drawings.

Before examining the drawings in detail, the display principle on a visualization screen a graphic mode is briefly recalled.

The image is created at the rate of the frame frequency, and each frame is generated by line sweeping, as is well known in television technology.

However, while in conventional video systems, the control of the guns (red, green, blue) of the image tube results in purely analog signals, the image composition system here controls these guns by binary state signals one or zero, or, in a more advanced system, by a digital circuit which provides for a "color palette" with all of the possible shades of half-tones.

Thus, each line of the frame is composed of a certain number of points (320 in a typical example), each one of which requires three elements of color information (R, G and B) in three bits, which yields a total of 120 bytes per line to be traced on the screen and 30K bytes per frame, if eight color shades are utilized.

At each display of a frame, synchronized with the video time base, the bytes containing the data relating to each image point are read into a memory called a "page memory", by a video display processor, or VDP, by means of which certain display functions can be effected. The page memory is loaded by a central processing unit, CPU, as a function of the input data which are set forth as a standard teletext broadcast, for example by television channel, or telephone line. The VDP also allows the adaptation of one to the other of the processing speeds of the display units and the CPU, allows the selection in a flow of input data of the flags for a magazine or page, and other analogous functions.

Figure 1:
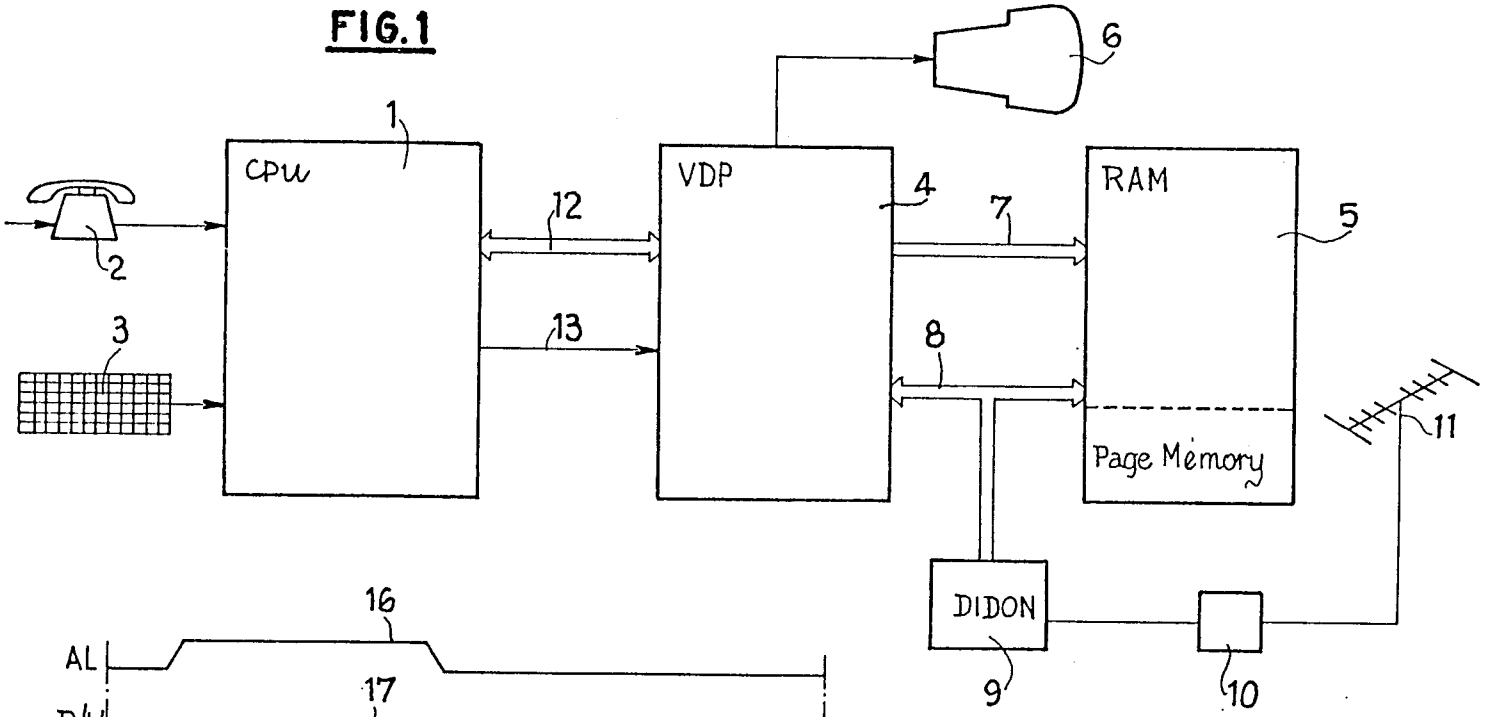
FIG. 1 is a very simplified diagram of the visualization system according to the invention.

There is seen in FIG. 1 the general architecture of such a visualzation system. It includes a central processing unit CPU 1 which is connected to one or more sources of information to be displayed. These sources can be telephone line 2 having information in teletext form, local keyboard 3, or any other source, such as for example a video game unit. The CPU 1 is connected to a VDP processor 4, which is itself connected to a random access memory 5, having a zone constituting a page memory. The VDP 4 is connected to display screen 6. The memory 5 communicates with VDP 4 by means of an address bus 7 and a data bus 8, this latter being connected to an adaption circuit 9 (called a "didon" in the literature) which provides for the extraction of a video signal transmitted, for example, by a high frequency television carrier by hertzian line, the teletext information being multiplexed with the television signals of a conventional television channel, ("antiope" for example). The adaption circuit 9 receives an input signal from receiver 10 which is itself connected to antenna 11. (For a summary description of an "antiope" system, reference can be made to an article in "La Technique de l'Ingénieur", E.3129).

According to the invention, the CPU 1 and the VDP 4 are connected by a common bus 12 on which circulate, in time sharing, the address fields and data fields, the assignment of these information fields being controlled by CPU 1 by means of signal CM (mode control), which is generated in addition to the conventional signals, address latch AL, data enabling EN, and read write R/W, travelling over control line 13. When the signal CM is at "1", events will occur as if the memory RAM 5 were directly connected to CPU 1 and controlled by the conventional signals AL, EN, and R/W. When the signal CM is at "0", the address field loaded by the usual signals is interpreted as an instruction for the VDP 4.

Figure 2:
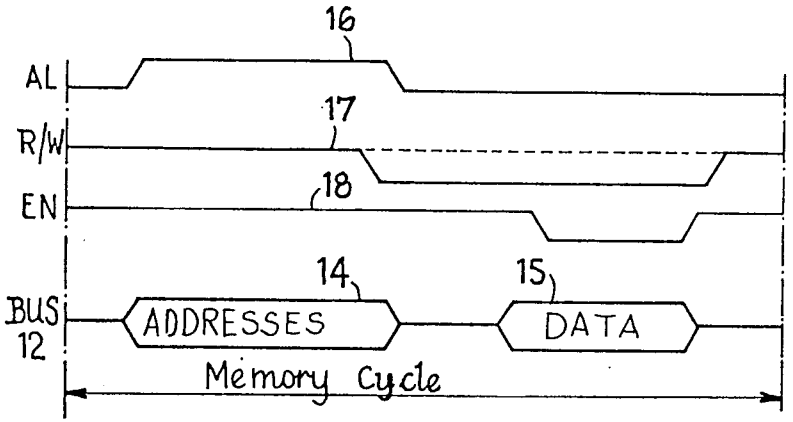
FIG. 2 shows a diagram of the signals for the time demultiplexing of the data fields and address fields circulating on a time sharing bus.

FIG. 2 shows a time diagram of a memory cycle. The signal on bus 12 is time multiplexed and includes, for each memory cycle, an address field 14 and a data field 15, the assignment of the bus 12 to an address field, or a data field, being controlled respectively by the signals AL, RW, and EN indicated by references 16, 17 and 18.

The information contained in address field 14 from the CPU 1 can be utilized in two manners.

1. The information can represent the addresses themselves by means of which the data field corresponding to the address field considered is stored in memory 5, transmitted via VDP 4, and this at the address contained in the address field which has also been authorized to travel through the VDP 4 (CM at 1).

2. The information can represent the particular display function by means of which the VDP 4 is placed into a particular functional configuration, the following data field being processed according to the function (CM at 0).

Figure 3:
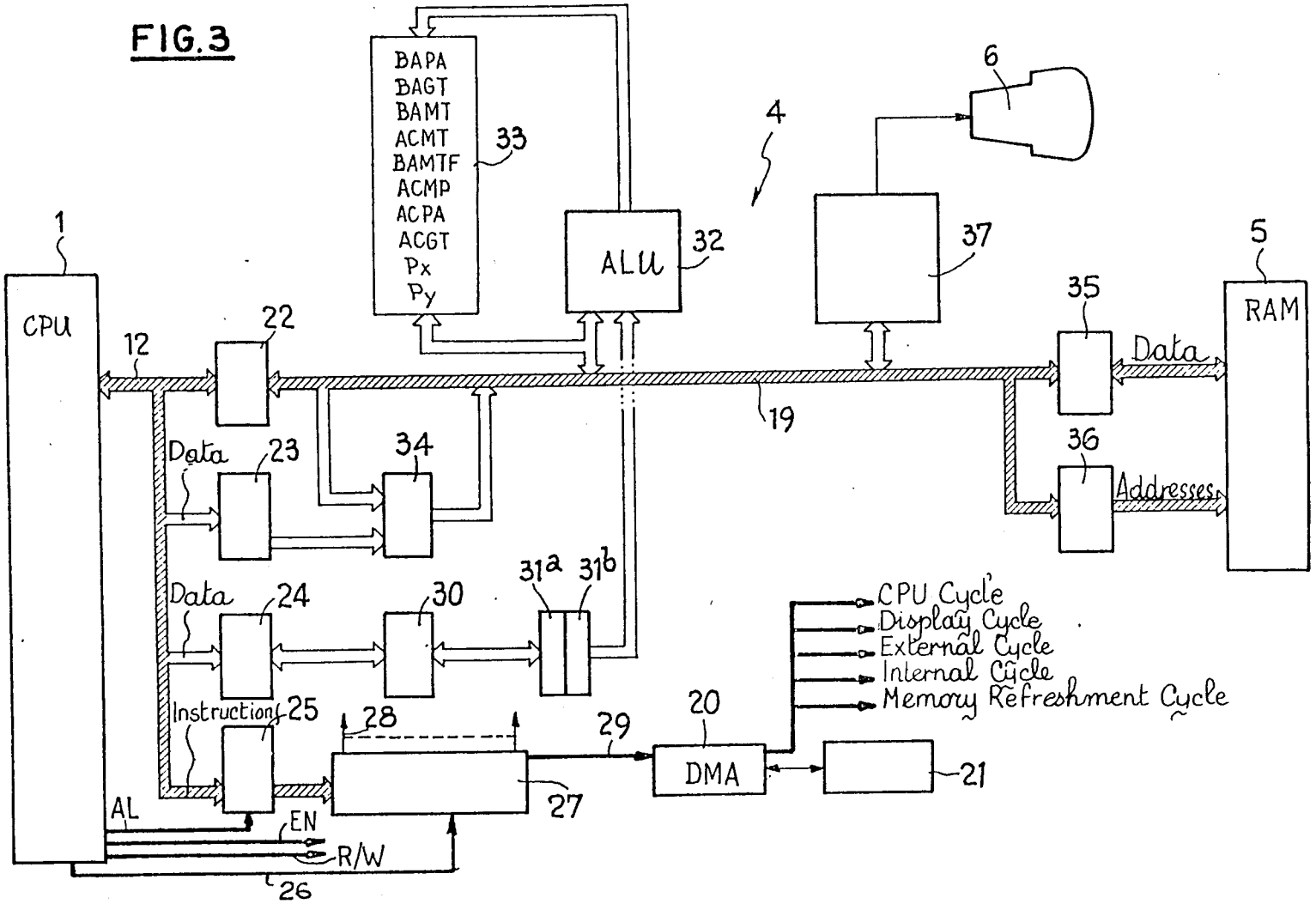
FIG. 3 is a simplified diagram of the video display processor utilized in the inventive system.

FIG. 3 shows the general architecture of the VDP 4 for processing the address fields of the CPU 1 as display function instructions and also for adopting a transparent configuration, when the CPU 1 provides address fields and data fields which are destined directly for memory 5, or receives the data from the memory as a function of the address which the CPU 1 directly applies to this memory.

The VDP 4 includes an internal bus 19 on which circulates all of the information exchanges which take place between the CPU 1, the memory 5, and the display device itself (screen 6).

The internal bus 19, which is bidirectional, transmits the address fields and data fields in time sharing under control of the direct memory access device 20, called hereinafter the DMA. This device can be of the type described in the U.S. Pat. No. 4,240,138 entitled "System for Direct Access to a Memory Associated with a Microprocessor", issued Dec. 16, 1980, by the instant assignee. The DMA cooperates with time base circuit 21 which is synchronized with the sweeping of the screen 6.

The CPU 1 is connected to VDP 4 by bus 12 which is connected with a set of four parallel registers 22, 23, 24 and 25. The register 22 is a data register in which each data field is temporarily stored before being transmitted on the internal bus 19 to memory 5. This register also transmits the address fields for directly addressing this memory, that is those fields which do not designate functions for the VDP 4.

The register 23 is a mask register and it stores a binary number which is decremented as the execution of a particular function is carried out.

Register 24 is a control register. It intervenes for the execution of another function in the VDP, as described hereinafter.

The register 25 is a transfer register for a function code represented by an address field provided by the CPU 1, the contents of which represent a specific function to be executed. This register is activated only when the CPU 1 indicates that the address field in question must render the VDP 4 non-transparent and ready to execute the given function. The register 25 for the transfer of the function codes is connected to decoder 27 which selectively provides, upon the reception of given code, enabling signals on outputs 28, which will be connected to the registers of the VDP 4 under control of the line 26, on which travels the signal CM. In other terms, each code received permits the sending, on a certain number of outputs 28, of enabling signals activating the registers of the VDP 4, which registers intervene in the course of the execution of the function represented by the code which traveled through transfer register 25 from the CPU 1. The decoder includes a particular output 29 which activates the DMA 20 when this is necessary to assure the internal control of the VDP 4, and, more particularly, to assure the time sharing of bus 19.

The control register 24, as well as the state register 30, which contains at each instant the internal state of the VDP, and the instructions in the course of execution and a double intermediate register 31*a*, 31*b*, are all connected to bus 12. The double register 31*a*, 31*b* is connected to an arithmetic and logic unit ALU 32 cooperating with register stack 33.

The mask register 23 is connected to a modification register 34 of which one of the inputs is from internal bus 19 and the output is looped back to internal bus 19. This bus is connected, on the memory 5 side, to data registers 35, and address registers 36, which are directly connected to the memory 5.

The output interface 37 provides for the adaption of the display data, travelling over internal bus 19 and coming from all including the circuits of the VDP 4, from the CPU 1, and the memory 5, to the display circuits themselves of screen 6.

The register stack 33 includes the following registers:

BAPA—address of the beginning of a page.

BAGT—address of the beginning of the control memory.

BAMT—address of the beginning of the buffer memory.

ACMT—buffer memory pointer assigned to the didon circuit 9 (FIG. 1).

BAMTF—pointer of the end of the buffer memory.

ACMP—pointer of the start of the buffer memory, on the CPU side.

ACPA—page memory reading pointer.

ACGT—control memory pointer.

PX, PY—CPU processing pointer.

The visualization system preferably includes a composite memory 5 which is made up of a page memory, a control memory, and a buffer memory, the ensemble being a single integrated circuit. In addition, advantageously, the limits assigned to these memories in this integrated circuit are not physically defined, but determined only by the addresses of the start and/or the end of the memory, which allows for great functional flexibility for the system as a whole. The limits can therefore vary during the course of the processing as a function of the information storage needs of the moment.

Buffer memory 5 (FIG. 1) adapts the processing speed of the didon circuit 9 to that of the CPU 1, as described in the copending U.S. patent application Ser. No. 715,788 entitled "Video Display Control System" filed Mar. 25, 1985, a continuation of U.S. patent application Ser. No. 328,777, filed Dec. 8, 1981 and now abandoned, in the name of the instant assignee.

In order to explain the functioning of the VDP circuit 4, and the operation of the display functions for the images on the screen 6, reference will be made successively to FIGS. 3 to 8, in which have been described in the connections over which travel the information during the execution of the composition function in question.

A - FIG. 3 - Direct access to memory 5 by the CPU (VDP transparent)

This function provides for the composition of images under the direct control of the CPU, for the updating of the page memory during the modification of the images to be displayed, and for the execution of other instructions in regard to which the VDP does not intervene. The VDP is therefore transparent during the course of execution of this function.

The cycle is carried out in the following manner.

Upon the appearance of the address field from the CPU, enabled by the signal AL and the signal CM being 1, the decoder 27 presents an access demand to the circuit 20 so that this circuit 20 will generate an access cycle for the internal bus 19, which will permit the VDP, which has become transparent, to access the memory 5, at the address set forth in the address field in the CPU, for the purpose writing the data which will be contained in the data field.

This process is, of course, reversible and the CPU can also read information from memory 5 during the execution of this function.

Figure 4:
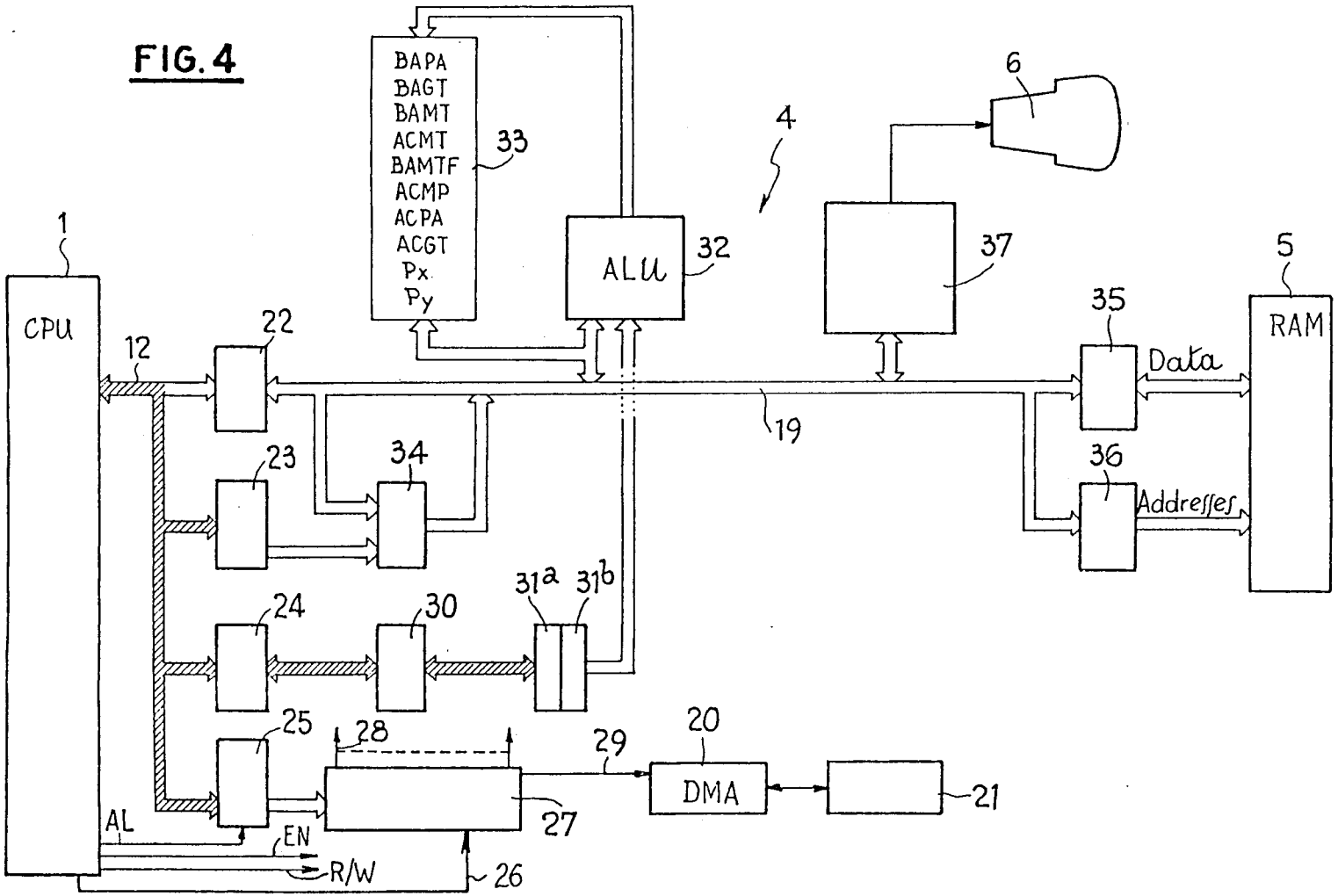
FIGS. 4 to 6 represent systems analogous to that of FIG. 3 showing other functional configurations of the display processor.

B - FIG. 4 - Access to the "programming" registers of the VDP

FIG. 4 depicts how the CPU can access the registers 23, 24, 30, 31*a* and 31*b* in order to place the VDP into a predetermined function state. In this case, the signal CM is at 0.

Upon reception of an instruction field from the CPU, the signal AL places the field in the selection register 25 and from there the corresponding information is introduced into decoder 27, the outputs of which provide the enablement of one or more of the above mentioned programming registers.

As a function of the contents of the address field, the following instructions can be executed:

LDRC, STRC—reading or writing from the instruction register 24 of the functioning mode of the VDP.

LDA or LDB; STA or STP—reading or writing of a value into the registers 31*a* or 31*b* which are used by the arithmetic and logic unit 32 for effecting a calculation operation.

LDST, STST—reading or writing of the state registers 30 which reflect the functioning and the different stages of image processing.

LDMSQ, STMSQ—reading or writing of a value into mask register 23 in order to determine the modification instructions of the image displayed.

RRMSQ, RLMSQ—the signal determines, with the mask register, a rotation to the left or right of a position of the mask value.

In each of these operations, that is, during each cycle of the CPU, the instruction field is followed by a data field adapted, on the one hand, to transfer the data to the register which, at a given moment, is enabled by the decoder 27, or, on the other hand, to place, in this field, the data which this register previously contained.

When a function is executed on the basis of FIG. 4, the VDP is not transparent, as the internal bus does not transmit either data or addresses to the memory 5.

Figure 5:
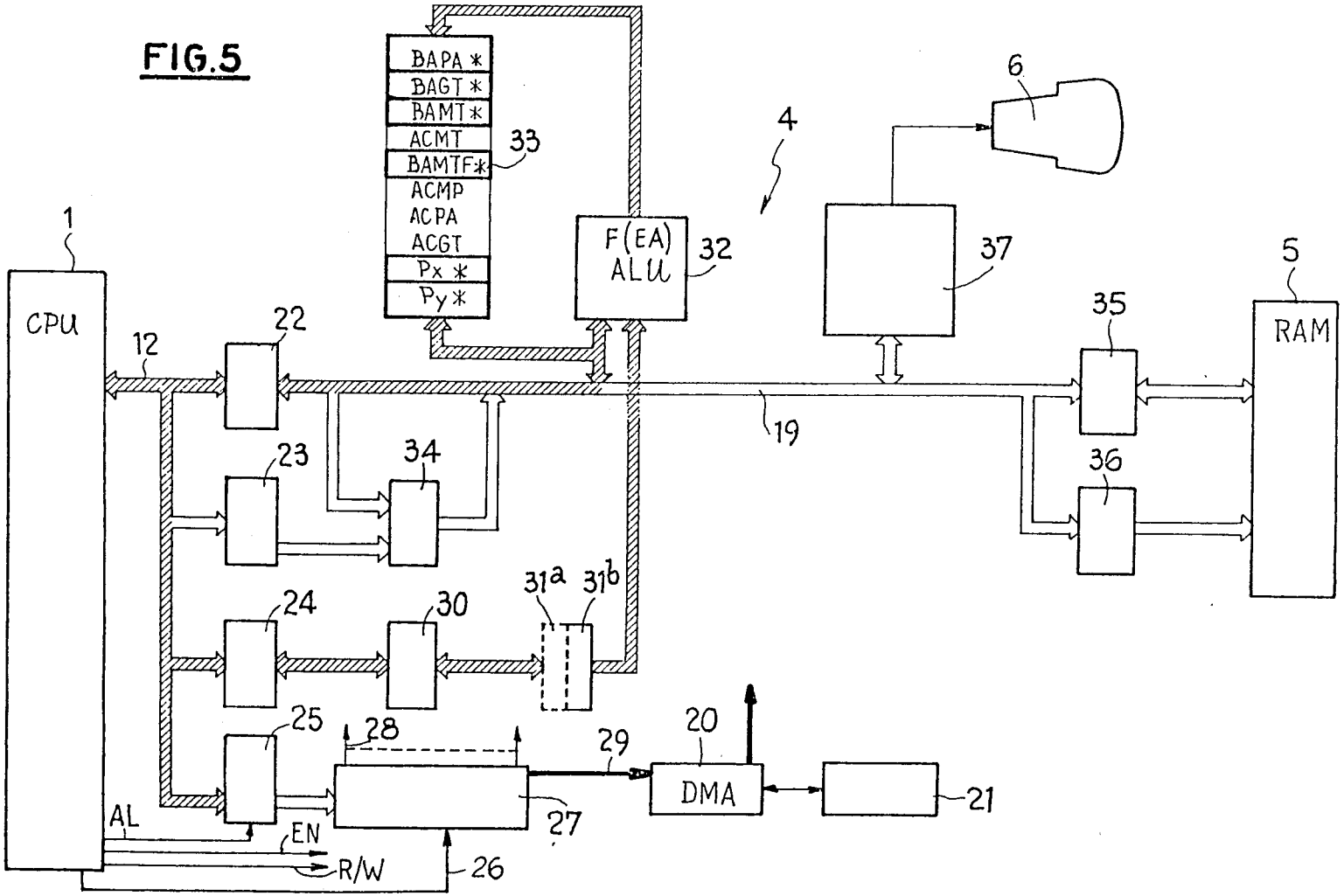

C - FIG. 5 - Access to register stack 33 determining the part of the memory 5 to be addressed The function of the registers of stack 33 was described above. In the course of execution of this function, only certain of the registers of the stack can be set into operation. These are indicated by an asterisk in FIG. 5.

As previously, the instruction field coming from CPU 1 is sent to selection register 25 which transfers this field to decoder 27, and, as the immediately following data field must traverse internal bus 19 in time sharing, the decoder will trigger the DMA circuit 20 which allocates a transmit time for this operation (the signal CM is at 0). The decoder also enables the arithmetic and logic unit 32, which remains transparent as there is to be merely the inscription of the data field into one of the registers of the stack 33. The unit 33 effects, therefore, the operation F (EA) which corresponds to transparence.

The reading of the data field into one of the registers of stack 33, (with a view towards a transfer to CPU 1), is effected under control of the DMA circuit 20. The contents of the register considered are transferred to the data register 22, while waiting to be transferred to the CPU bus 12.

One can execute various instructions with this VDP configuration, namely:

LPDA, STPA—reading or writing of the address of the base of the page during display.

LDGT, STGT—reading or writing of the address of the base of the control memory utilized for display.

LDMT, STMT, LDMTF, STMTF—reading or writing of the addresses defining the beginning and end of the buffer memory.

LDPX, STPX, LDPY, STPY—reading or writing of the current values temporarily stored in the pointers PX and/or PY utilized by the CPU for image processing.

Figure 6:
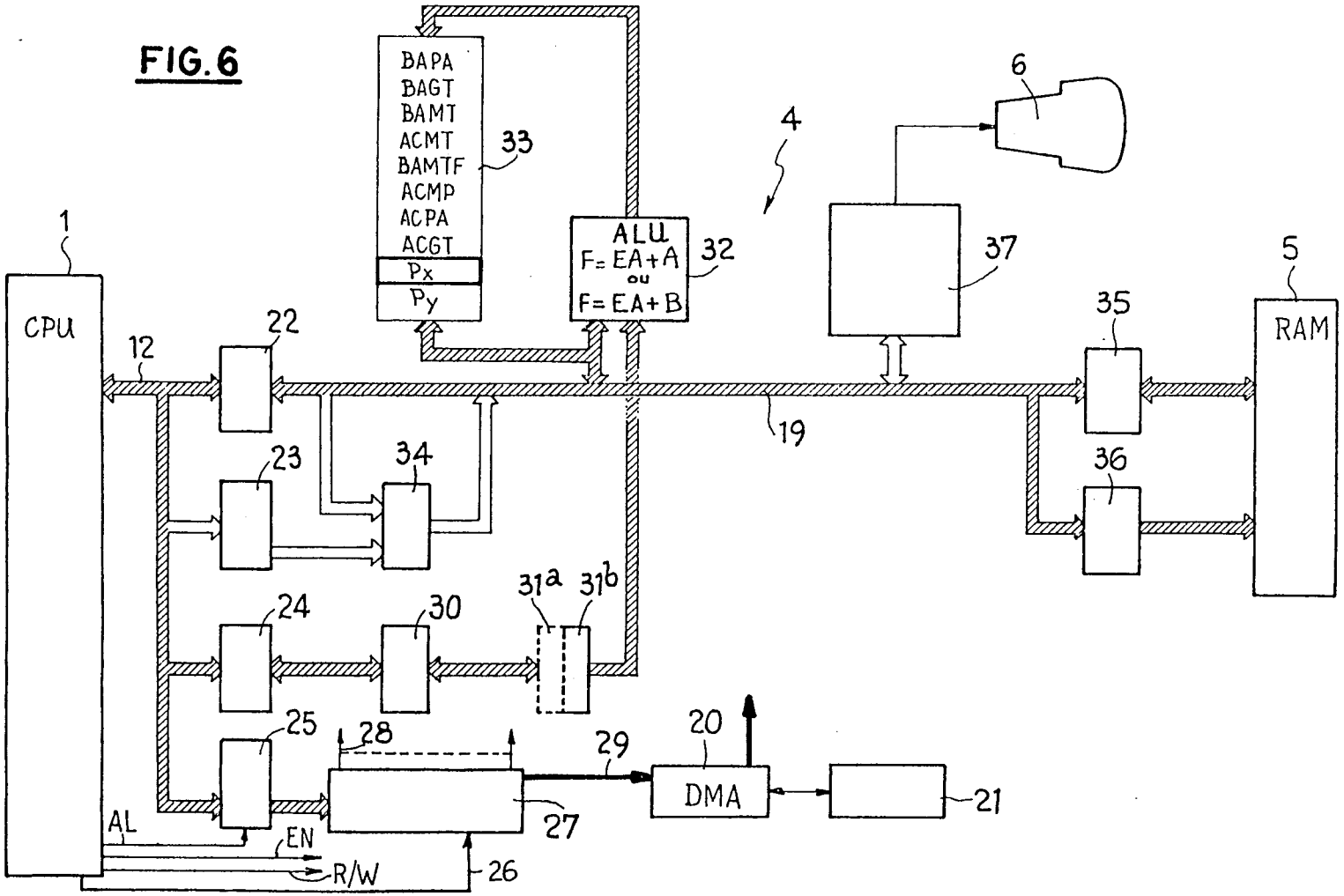

D - FIG. 6 - Control of access to the addresses of memory 5 as a function of a preselected criteria This function is carried out under the control of the CPU 1 by means of registers PX or PY of the stack 33, by means of unit 32, and one or the other of the registers 31*a* or 31*b*. The function can be useful for the display of a particular image characteristic (vertical bar of a particular color, particular graphical form of which the characteristics are contained in the CPU, or a particular color to be displayed over all, or a portion, of the screen). The signal CM still is at 0.

For example, if a vertical bar is to be displayed, the addresses are placed into the page memory 5 which correspond to a particular distance from the left hand margin of the image and the data will correspond to a certain color. This places the same data at addresses which differ by an amount of 120 (number of bytes per line).

Figure 7:
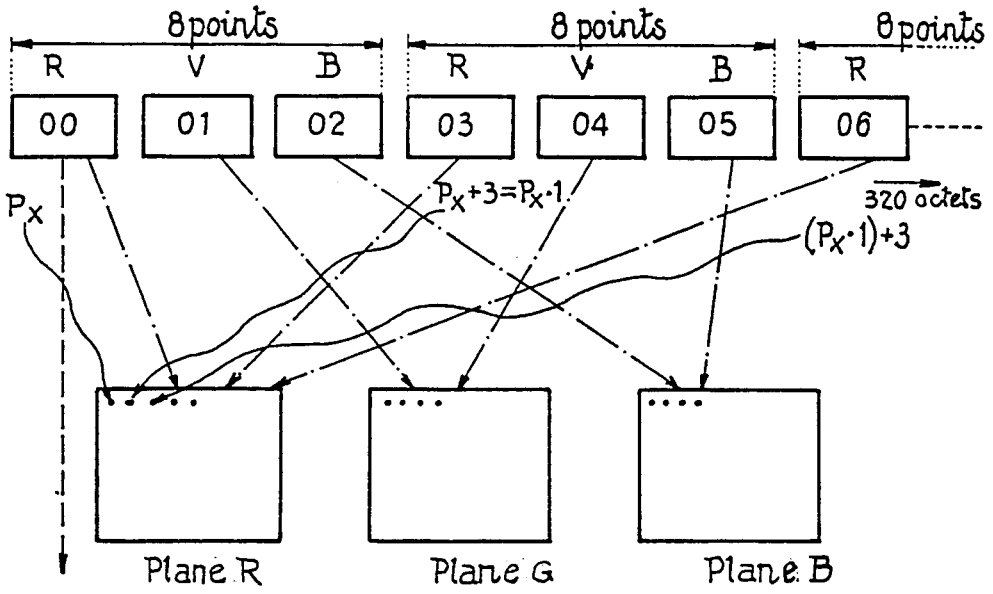
FIG. 7 is a diagram illustrating the organization of the page memory of the visualization system into "memory planes".

If all or a part of the screen is to be displayed in an identical color, this function can be conveniently used. Reference can be made to FIG. 7 which illustrates a concept which utilizes this function, in accordance with a particular aspect of the invention. This is the concept of the "memory palne".

FIG. 7 shows schematically a few bytes of the first line of the memory page contained in the RAM 5, a line which is to be presented on the screen as the first line of the frame, at a given moment.

The rectangles in the upper part of the figure represent the first six bytes of a row of the memory (line of a screen) at addresses 01 . . . 06, etc (in hexadecimal). This byte also contains the color information for eight points on the screen, a "1" in one bit of the byte indicating, for example, the presence of a color and a "0" indicating the absence thereof. It is seen that, to display red at all of the points of the row, the addresses of the bytes are to be increased by 3 and that the data field of the bytes is to contain a "1". There is thus obtained conceptually, the "memory planes" indicatd by the lower rectangles in FIG. 7, each plane representing a given color of the image (red, green and blue). This organization of the page memory, to which numerous variations can be brought, can be advantageous used according to the invention. The execution of the function described hereinafter is made with reference again to FIG. 6.

Upon the arrival of an address field (instruction to CPU, CM=0), the decoder 27 enables the necessary registers according to the contents of this field.

One of the enabled registers can be the pointer PX or the pointer PY. The reading or writing of a data field to the address contained in the pointer PX or PY, selected on the internal bus 19 under control of circuit 20 controling time sharing of bus 19, can then take place. The address thereby obtained is transferred over bus 19 into register 36 which selects the corresponding emplacement in the memory 5. During the same period, the arithmetic and logic unit 32 calculates the address of the next access by adding the value A or B to PX or PY according to the function $F=EA+A$ or $F=EA+B$, depending upon whether the unit 32 is operating on the contents of register 31*a* or 31*b*, enabled by decoder 27.

During a second period, the data for the selected address is transferred to register 22 over bus 19 for loading into the memory via circuit 35, or, vice versa, from the RAM 5 via circuit 35 over bus 19 for loading into register 22, prior to being read by the CPU 1.

This function corresponds to the following instructions:

LDPX (A), STPX (A)—reading or writing of a data field at the address of the memory contained in the pointer or register PX and the transfer of PX+A in this register after access (combination with register 31*a*).

The analogous instructions LDPX (B) and STPX (B) regarding register 31*b* can also be executed.

Figure 8:
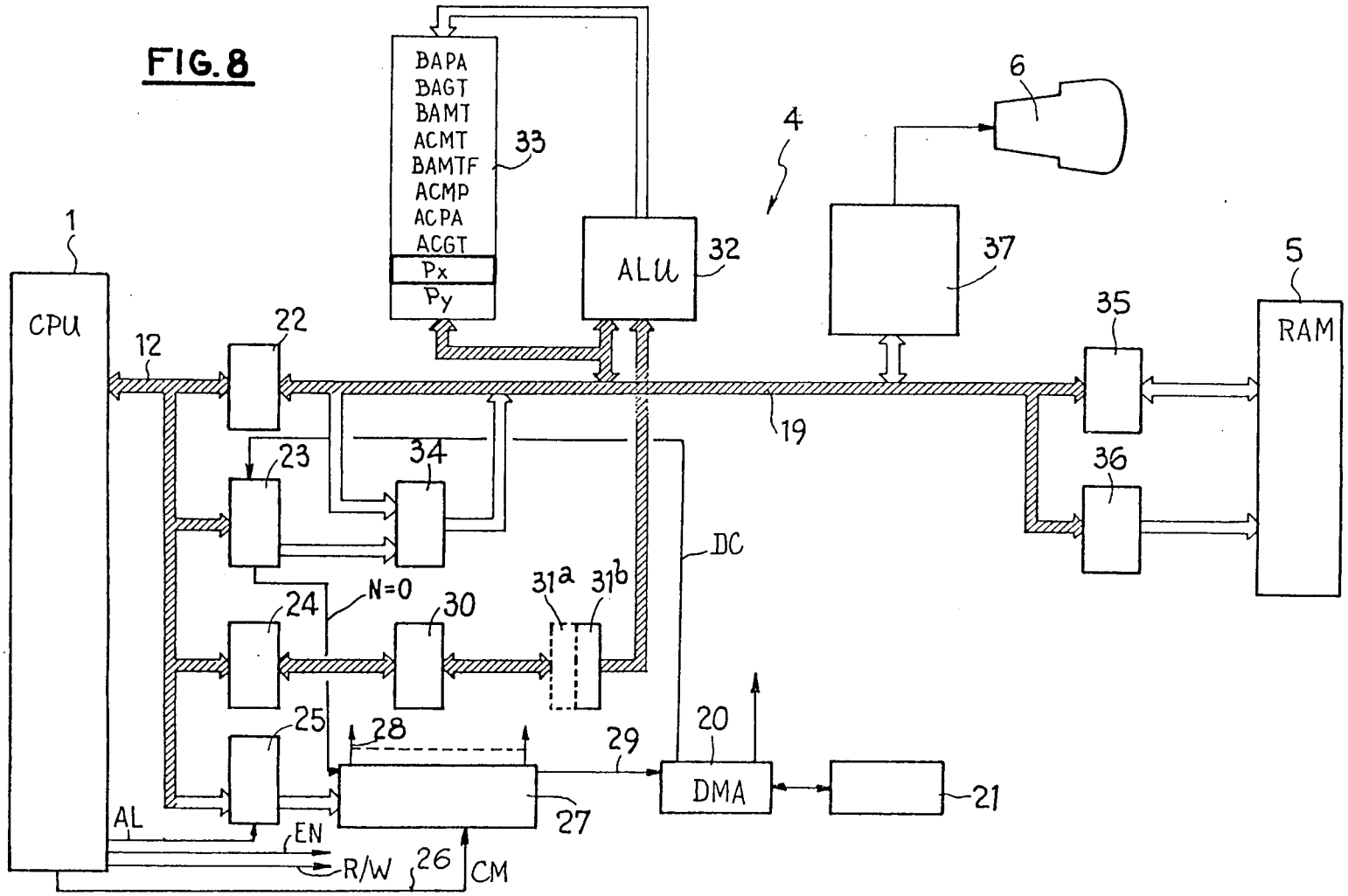
FIG. 8 shows another configuration of the display processor.
Figure 10:
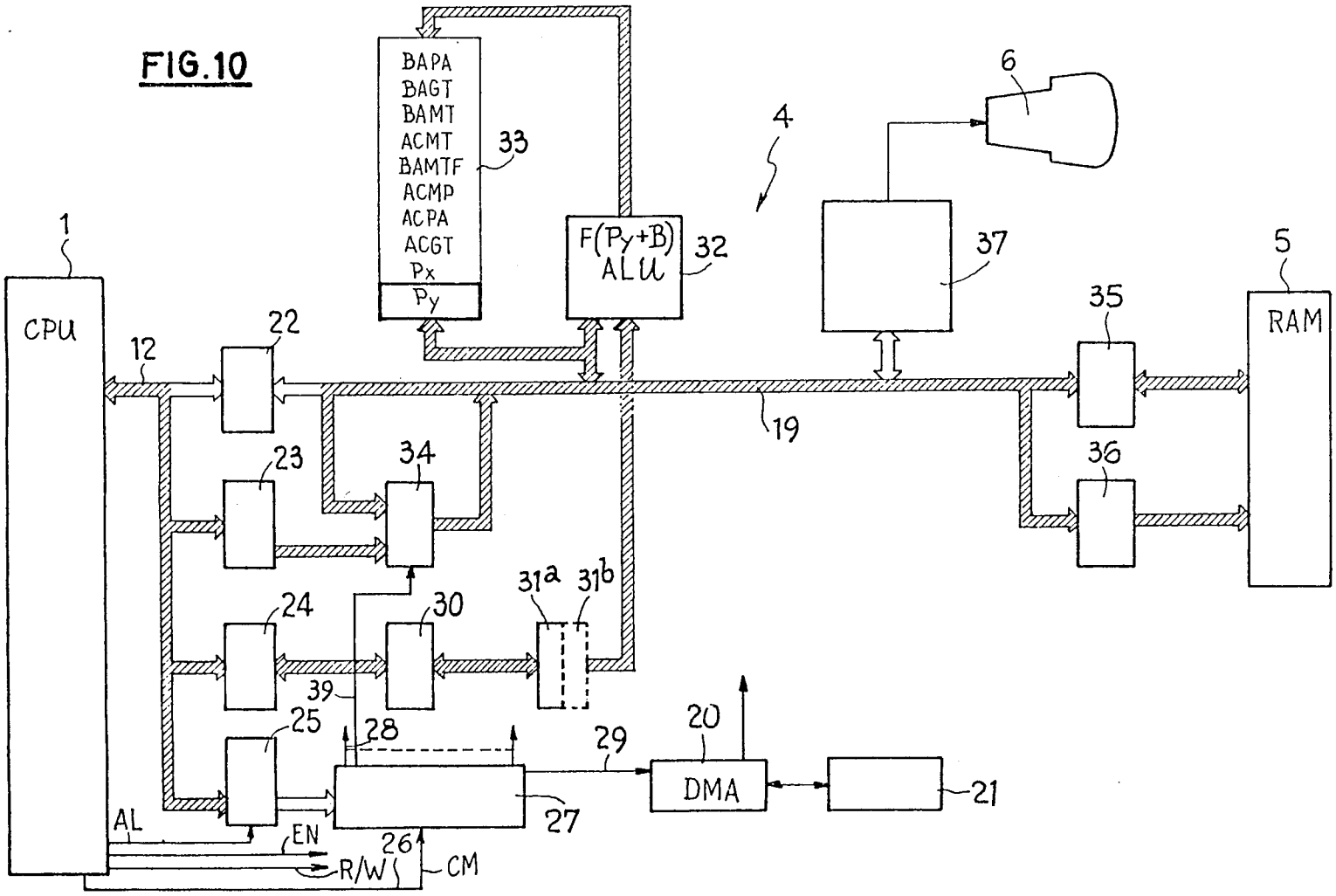
FIG. 10 shows another configuration of this processor.

E - FIG. 8 - Repetitive access to memory planes

The advantages and the speed of execution obtained with the invention are particularly seen in regard to the function illustrated in FIG. 8. This instruction provides for loading, into one or more memory planes of the page memory, of a data constant, by means of an extremely reduced number of execution cycles of the CPU 1 (CM=0).

During a prior operation, after the processing of an instruction field by selection register 25 and decoder 27, the following data field from the CPU 1 is loaded into mask register 23. This data field contains the number of repetitive loadings to be executed.

The address fields and following data fields, containing the address and the data to be loaded to this address, are processed in a manner previously described, by means of pointers PX or PY, arithmetic and logic unit 32, and registers 31*a* or 31*b*, all of this under control of circuit 20 which controls the internal bus 19 in time sharing (function LDPx $A^n$).

Without the intervention of the CPU, the internal cycle is repeated n times, n being the value loaded during the previous CPU cycle into register 23, as described above.

At each memory access, the DMA 20 decrements, by conductor DC, the register 23 until the value n becomes 0. The conductor over which travels the value n=n=0 is connected to decoder 27, so that the decoder will suppress the control, on line 29, for access request to DMA 20.

This process allows for an extremely rapid loading of the memory, as the memory plane of 10K bytes requires a loading time of about 1.5 ms, while if there were utilized a sequential loading, before the intervention of the CPU to each address, there would be required 100 ms for the same number of bytes.

F - FIG. 9, 10, 11A and 11B - Form transfer or modifications

Figure 9:
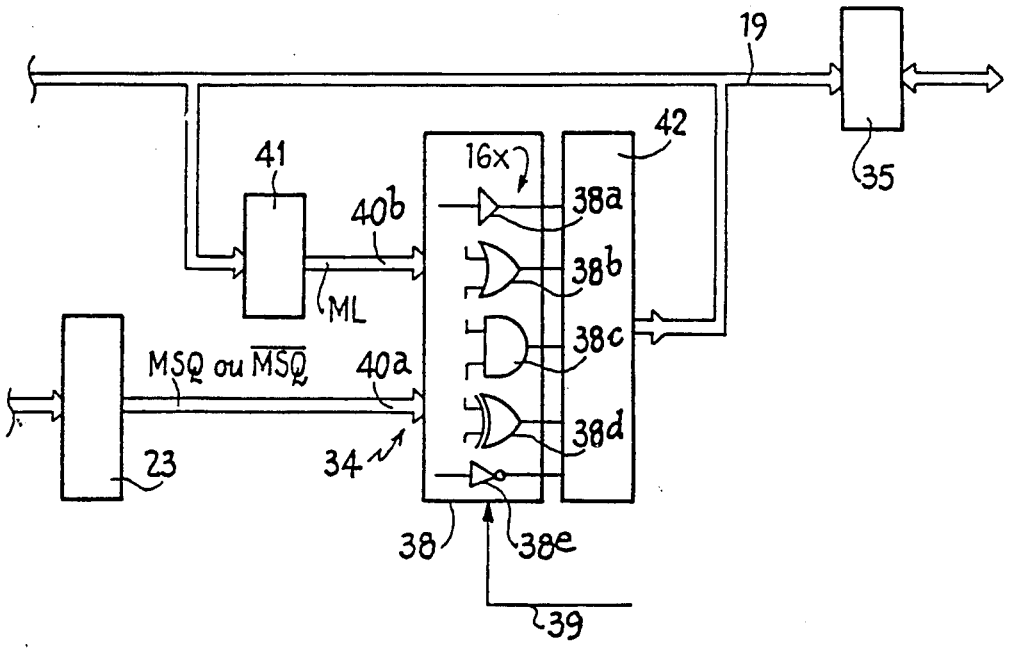
FIG. 9 is a simplified diagram of the image modification element utilized in the display processor.

For the understanding of this function, it is useful to refer to FIG. 9 which shows in more detail the modification element 34. This element contains a logic processing circuit 38 in which can be executed the logical functions, on 16 bits for example, on two input signals, also in the form of sixteen bits. These functions are, for example, "true" (38*a*), OR (38*b*), AND (38*c*), NOT-AND (38*d*), and "inversion" (38*e*).

The selection can be effected by means of the control lines 39 which make up the outputs of the decoder 27 (FIG. 9).

The first input 40*a* of the processing circuit is connected to mask register 23 which provides to this circuit information on the eight image points to be displayed on the screen. This information (signal MSQ or MSQ of FIG. 11B) can, for example, come from a form memory, a character generator, or another analogous source which, preferably, makes up a part of the memory 5.

The input 40*b* of the processing circuit is connected to a memorization register or reading memory 41 in which are loaded the contents of the two bytes of the page memory (memory 5) on which a modification is to be effected. It is recalled that each bit of this page memory controls a point to be displayed on the screen and that the memory is preferably organized in "memory planes" as described above.

The individual outputs, in 16 bit form, of the logical processing circuit 38 are connected to multiplexor 42, the multiplex output of which is connected to internal bus 19.

Figure 11A:
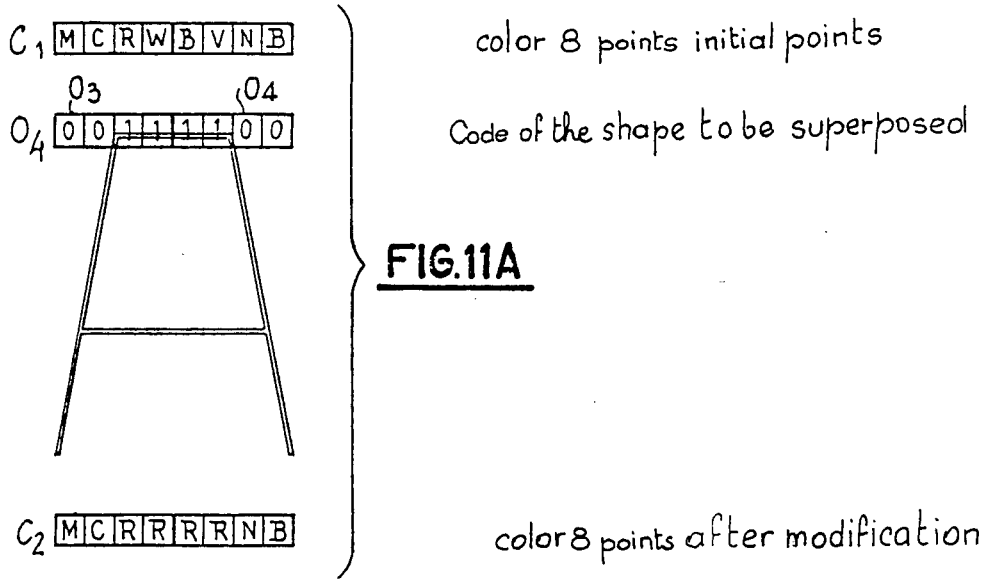
FIGS. 11A and 11B illustrate the function effected by the display processor when it is in the configuration of FIG. 10.

The execution of this modification function will be now described by means of a particular example which consists, as can be seen in FIG. 11A, of superimposing, at a given location of the displayed image, a letter A over the information which appears here. There will only be described the superimposition of the upper horizontal bar, the operation being carried out over all of the image zone in question in a manner which will be described. It is to be understood that this modification is effected, in the portion of the page memory of the memory 5, on the data which are stored there.

In order to simplify, the description is in regard to eight points on the screen, the colors being defined by rectangle C1 of FIG. 11A by means of three bytes 01, 02 and 03, which belong respectively to planes R, G and B which, by their combination, produce on the screen eight points having the following colors magenta, cyanic, red, white, blue, green, black. It is supposed that the upper bar of the letter A defined in the rectangle 04 of FIG. 11A is to be superimposed in red on the eight points of C1.

Upon the appearance of the instruction field from the CPU on bus 12, the register 25 is enabled by the signal AL on line 26 and the decoder 27 enables the registers needed for the execution of this operation and enables circuit DMA 20 which allocates a time interval on internal bus 19 (CM=0). During the previous CPU cycle, the address of the byte 01 (11B) of the red plane, relating to the image points to be modified, was introduced into the register PX.

The information of byte 01, that is, 1011.0000 is read into the memory and transferred over internal bus 19 to register 40 (FIG. 9) of modification circuit 34.

The data field following the address or instruction field in question is sent to the mask register 23 (byte 04-0011.1100). The logic function OR has been selected by the control field via register 25 and decoder 27, with the siganl traversing line 39 and the logic processing circuit 38 effects bit by bit the logical operation OR on the bytes 01 and 04 which yields the byte 05-1011.1100. This result is rewritten at the address PY of the register stack, all of this under control of the circuit DMA 20.

Thereafter, the information of the memory planes green and blue are processed in the same manner, however, the signals M and MSQ are subjected to an AND operation which provides bytes 06 and 07 respectively.

Figure 11B:
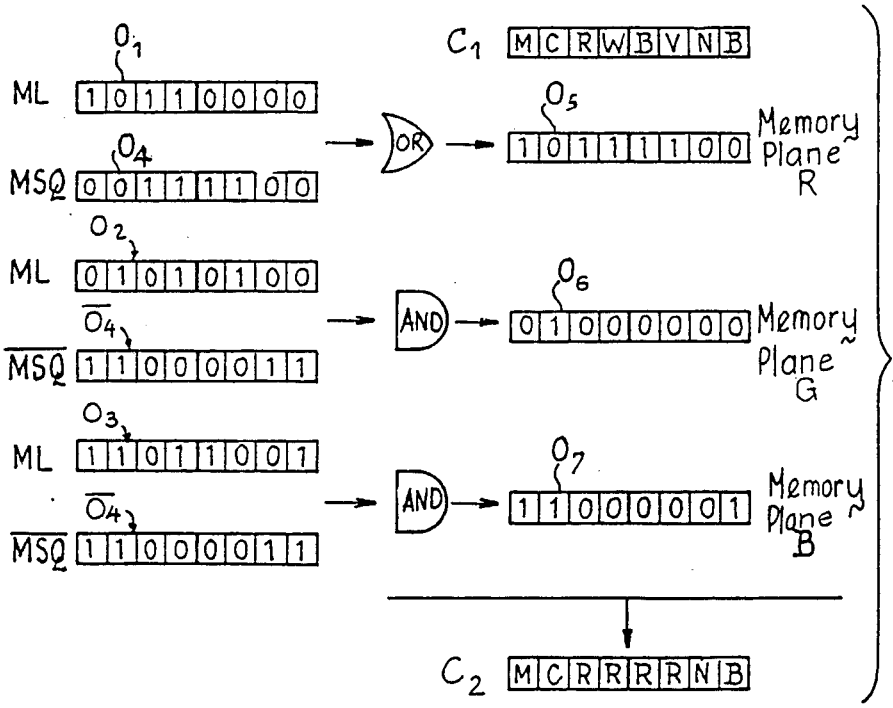

Thereafter, during the display on the screen by combination of the bytes 05 and 07, one again finds the image points of which the intermediate points are all of the color red, as represented in the rectangle C2 of FIGS. 11*a* and 11*b*.

Of course, between the operations relating to memory planes R, G and B, the CPU 1 effects a modification operation on the address contained in the pointer PY, this modification being effected by a CPU cycle having an instruction field and a data field, the data field containing the difference between the initial PY address and the new address PY. The operation of addition of this difference to the former address PY is effected by registers 31*a* or 31*b* and the arithmeric and logic unit 32, as described in regard to FIG. 6.

After processing the bytes in the three memory planes R, G, B corresponding to the image points C1 (which has become C2), the system can effect the same process on the group of eight image points located below the image point C1, to successively superimpose the ensemble of the points of the letter A on the points which have been displayed. (It is noted that, in the above, the term "image point" designates a point written from the three guns R, G and B of the image tube).

It is also to be noted that the process which has been described can be repeated n times as described in regard to FIG. 8 providing there is a double mask register 23, one for registering the number of repetitions to be executed, and the other for registering the 16 bits of the Figure to be added to or superimposed on the image.

On can also very easily effect a color inversion of the image by utilizing the function "inversion" 37*e* of the logic processing circuit 38 of FIG. 9.

It is clear that, according to the above description, the invention has the considerable advantage of being able to execute practically all of the image processing functions in the VDP itself, with recourse only to those instructions provided in the CPU by programming. The CPU is therefore relieved of most of its functions and can, during the execution of the functions, be assigned to other tasks. In addition, the CPU cycle being relatively long, one can gain considerable time in regard to processing image information, the display can be executed very rapidly, and practically instantaneously, as to the screen observer.

Finally, the programming of a magazine to be displayed is made considerably easier.

Figure 12:
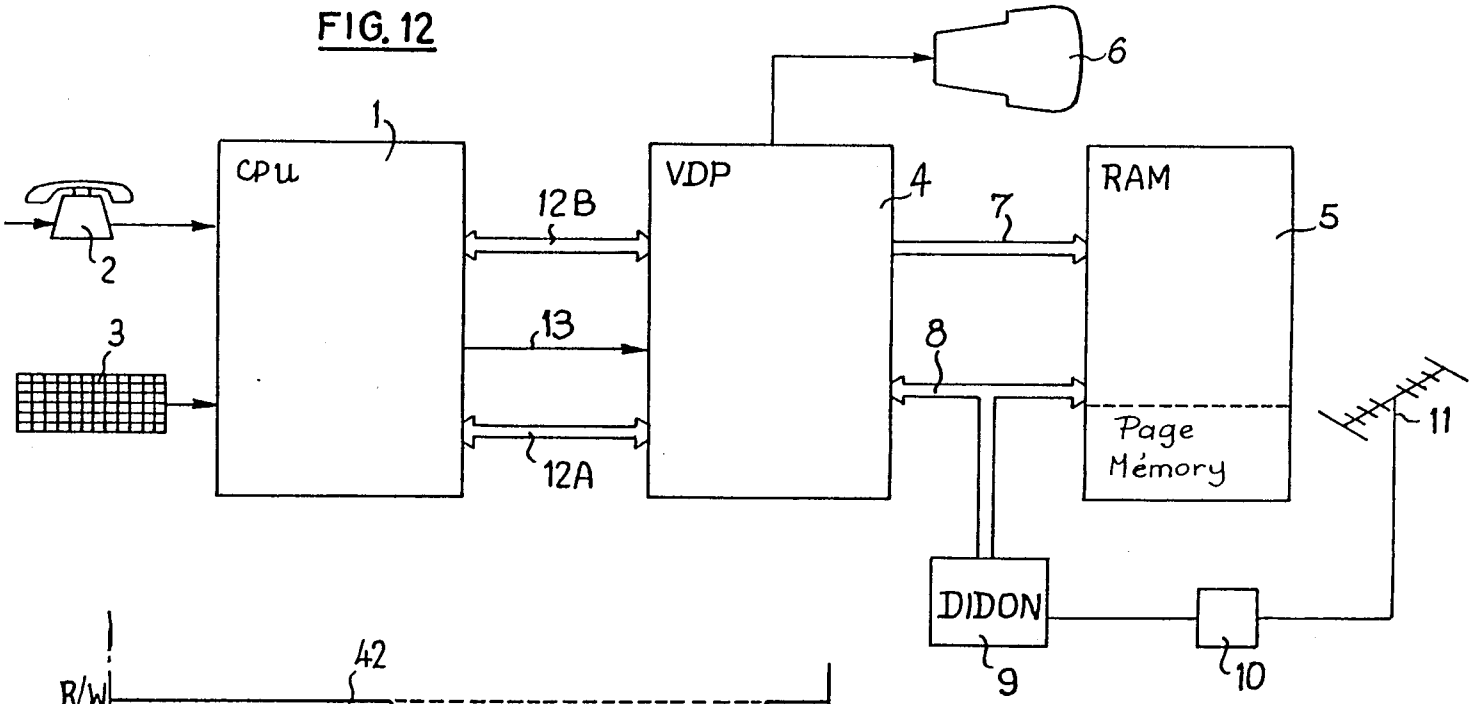
FIG. 12 is a very simplified diagram of a dual buss visualization system according to the invention.

In FIG. 12, the CPU 1 and VDP 4 are connected by a data bus 12A and by address bus 12B, the storing of the information from the CPU being controlled by the CPU 1 by means of data enable signals EN, and read write signals R/W, transmitted over control line 13. According to the invention, the CPU can also generate an assignment signal CM as to certain addresses on bus 12B, this signal, according to whether it is one or zero, permits the interpretation of these addresses as an address per se of the memory 5 or as an instruction for the VDP 4. Thus, when the signal CM is "1" events occur as if the memory RAM 5 was directly connected to CPU 1 and controlled by the usual signals EN and R/W. On the other hand, when the signal CM is at "0", the address loaded by the usual signals is interpreted as instructions for the VDP 4.

Figure 13:
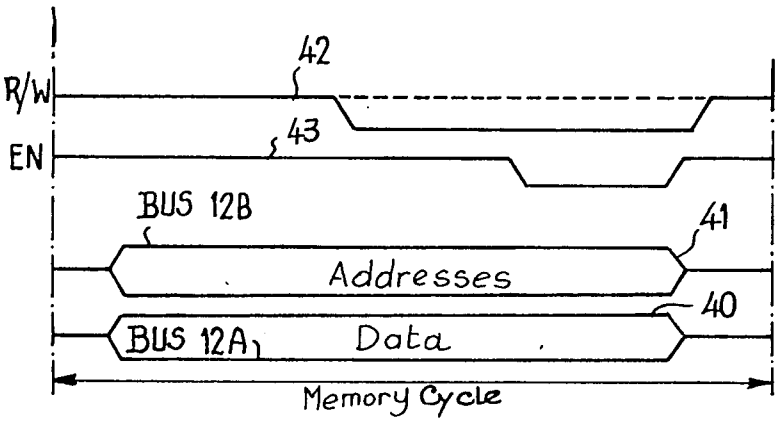
FIG. 13 shows a diagram of the signals for the data fields and address fields.

FIG. 13 shows a timing diagram for the memory cycle. The data 40 and the addresses 41 which traverse bus 12 and 12b, are controlled by the signals R/W and EN indicated at 42 and 43.

The information represented by the addresses 41 coming from the CPU can be utilized in two manners:

1. The information can represent the addresses per se, through which the data associated with the address in question can be stored in memory 5, passing via VDP 4, and this at said address which is transmitted via bus 12b and address register 36 (CM at 1).

2. The information can represent the particular display function instructions by means of which the VDP is placed into a particular configuration for this function, the data associated with this address being then treated according to the corresponding function (CM at 0).

I claim:

1. A system for displaying a graphical visual image on a video screen comprising:

a video display unit (6) including a video screen for displaying a graphical visual image;

a display control unit (37) connected to said video display unit (6) for receiving display control signals and controlling said video display unit in accordance with said received display control signals:

a page memory (5) for storing therein video information defining said graphical visual image to be displayed;

a central processing unit (1) connected to a single bus (12) upon which are transmitted address fields (14) and data fields (15) on a time shared basis and a control line (13) upon which is transmitted an assignment signal (CM); and a video display processor (4) connected to said display control unit (37) and said page memory (5) for recalling video information stored in said page memory (5) and converting said recalled video information into corresponding display control signals for application to said display control unit (37), said video display processor (4) including an arithmetic and logical unit (32), a register, and a decoder circuit (27), said arithmetic and logical unit (32) and said register connected to said single bus (12), and said decoder circuit (27) connected to said single bus (12) but interpreting data or said single bus (12) as an address field (14) or as a control field (15), and to control the function of said video display processor (4) in response to said assignment signal (CM) on said control line (13), said decoder circuit (27) having a plurality of enabling outputs (28) for transmitting function signals to said arithmetic and logical unit (32) and to said register, enabling said video display processor (4) to execute data processing functions on a data field received on said single bus, said functions corresponding to said data received on said single bus (12) and interpreted as a control field (15) in response to said assignment signal (CM).

2. A system according to claim 1 characterized in that;

said central processing unit (1) further includes means for generating an address latch signal on an address latch line (AL); and said video display processor (4) further includes a register (25) connected to said single bus (12), said address latch line (AL) and said decoder circuit (27) for connecting said single bus (12) to said decoder circuit (27) upon receipt of said address latch signal.

3. A system according to any one of claims 1 or 2 characterized in that said video display processor (4) includes an internal transfer bus (19) connecting said single bus (12) to said page memory (5) by a bi-directional connection so that said central processing unit (1) can transmit said data fields and said address fields or said internal transfer bus (19) on a time shared basis.

4. A system according to claim 3 characterized in that said video display processor (4) includes a time sharing control circuit (20) which controls the circulation of said data fields and said address fields on said internal transfer bus (19).

5. A system according to claim 4 characterized in that said time sharing control circuit (20) is connected to said decoder circuit (27) so that it can assign a cycle time to said internal transfer bus (19) when said data fields and said address fields must be transmitted on a time shared basis on said internal transfer bus (19).

6. A system according to claim 3 characterized in that:

said video display processor (4) includes a plurality of registers connected to the enabling outputs of decoder circuit (27). said plurality of registers including a register stack (33) for containing addresses defining zones of said page memory (5) assigned to predetermined functions;

and in that said arithmetic and logical unit (32) is connected to said register stack (33) for effecting, on these addresses, predetermined calculations for modifying the composition of the graphical visual image to be displayed, said register stack (33) and said arithmetic and logical unit (32) being connected to said internal transfer bus (19) and to said decoder circuit (27) for being enabled by the address fields interpreted as instruction supplied from said central processing unit (1).

7. A system according to claim 6 characterized in that said plurality of registers in said video display processor (4) a control register (24), a status register (30), and at least one buffer register (31*a*, 31*b*) all connected to said single bus (12) of said central processing unit (1) and wherein said buffer register (31*a*, 31*b*) is connected to said arithmetic and logical unit so that this latter can effect the logical operations on a current address and a preceding address stored in the registers (PX or PY) of said register stack (33).

8. A system according to any one of the claims 1 or 6 characterized in the said video display processor (4) further includes a mask register (23) connected to said single bus (12) of said central processing unit (1) for containing a number corresponding to a repetition of an image composition function to be executed by said video display processor (4), said mask register (23) being also connected to said decoder circuit (27) for, if appropriate, being enabled by the latter.

9. A system according to claim 8 characterized in that said mask register (23) is connected to said time sharing control circuit (20) which is adapted to count down the number which is contained in this register, at each accomplished cycle of repetition, or analogous composition function and wherein said mask register (23) is also connected to said decoder circuit (27), for cancelling said enabling signals (28) at the outputs of said decoder circuit (27) when the contents of said mask register (23) reach zero.

10. A system according to any one of the claims 1 or 6 characterized in that said video display processor (4) includes modification means (34) for effecting modifications of the composition of the image to be displayed by a logical combination of the image data already stored in said page memory (5) and modifications of image data which are supplied to it by said central processing unit (1).

11. A system according to claim 10 characterized in that said modification means (34) include a first input (40*a*) through which it is connected to said central processing unit (1) and a second input (40*b*) through which it is connected to said internal transfer bus (19) of said video display processor (5), its output also being connected to said internal transfer bus (19), and wherein said modification means (34) includes a logical function selection input (39) connected to said decoder circuit (27) as well as a network of logical circuits (38*a* to 38*e*) for the execution of logical functions on the addresses which are applied to it on the two inputs during the execution of a modification function.

12. A system for displaying a graphical visual image on a video screen comprising:

a video display unit (6) including a video screen for displaying a graphical visual image;

a display control unit (37) connected to said video display unit (6) for receiving display control signals and controlling said video display unit in accordance with said received display control signals;

a page memory (5) for storing therein video information defining said graphical visual image to be displayed;

a central processing unit (1) connected to an address bus (12*b*) upon which are transmitted address fields (41) and to a data bus (12*a*) data fields (40) and a control line (13) upon which is transmitted an assignment signal (CM); and a video display processor (4) connected to said display control unit (37) and said page memory (5) for recalling video information stored in said page memory (5) and converting said recalled video information into corresponding display control signals for application to said display control unit (37), said video display processor (4) including an arithmetic and logical unit (32), a register, and a decoder circuit (27), said arithmetic and logical unit (32) and said register connected to said data bus (12*a*), and said decoder circuit (27) connected to said address bus (12*b*) for interpreting data on said address bus (12*b*) as an address field (41) or as a control field, and to control the function of said video display processor (4) in response to said assignment signal (CM) or said control line (13), said decoder circuit (27) having a plurality of enabling outputs (28) for transmitting function signals to said arithmetic and logical unit (32) and to said register, enabling said video display processor (4) to execute data processing functions on a data field received on said data bus (12*a*), said functions corresponding to said data received on said address bus (12*b*) and interpreted as a control field in response to said assignment signal (CM).

13. A system according to claim 12 characterized in that:

said central processing unit (1) further includes means for generating an address latch signal on an address latch line (AL); and said video display processor (4) further includes a register (25) connected to said address bus (12*b*), said address latch line (AL) and said decoder circuit (27) for connecting said address bus (12*b*) to said decoder circuit (27) upon receipt of said address latch signal.

14. A system according to any one of the claims 12 or 13 characterized in that said video display processor further includes a mask register (23) connected to said data bus (12*a*) of said central processing unit (1) for containing a number corresponding to a repetition of an image composition function to be executed by said video display processor (4), said mask register (23) being also connected to said decoder circuit (27) for if appropriate, being enabled by the latter.

15. A system according to claim 13 characterized in that said video display processor (4) includes a time sharing control circuit (20) which controls the time sharing on said internal transfer bus.

16. A system according to claim 15 characterized in that said time sharing control circuit (20) is connected to said decoder circuit (27) so that it can assign a cycle time to said internal transfer bus (19) when the information is to circulate in time sharing or said internal transfer bus (19).

17. A system according to claim 12 characterized in that:

said video display processor (4) includes an internal transfer bus (19) connecting said address bus (12b) and said data bus (12a) to said page memory (5) by a bi-directional connection so that said central processing unit (1) can transmit said data fields and said address fields on said internal transfer bus (19):

in that said video display processor (4) includes a plurality of registers connected to the enabling outputs of decoder circuit (27), said plurality of registers including a register stack (33) for containing addresses defining zones of said page memory (5) assigned to predetermined functions;

and in that said arithmetic and logical unit (32) is connected to said register stack (33) for effecting, on these addresses, predetermined calculations for modifying the composition of the graphical visual image to be displayed, said register stack (33) and said arithmetic and logical unit (32) being connected to said internal transfer bus (19) and to said decoder circuit (27) for being enabled by the address fields interpreted as instruction supplied for said central processing unit (1).

18. A system according to any one of the claims 12 or 13 characterized in that said video display processor (4) includes modification means (34) for effecting composition modifications of the image to be displayed by a logical combination of the image data stored in said page memory (5), and modification of image data which are supplied to it by said central processing unit (1).

19. A system according to claim 18 characterized in that:

said video display processor (4) includes an internal transfer bus (19) connecting said address bus (12*b*) and said data bus (12*a*) to said page memory (5) by a bi-directional connection so that said central processing unit (1) can transmit said data fields and said address fields or said internal transfer bus (19);

and in that said modification means (34) includes a first input (40*a*) connecting it to said central processing unit (1), and a second input (40*b*) connecting it to said internal transfer bus (19);

and wherein said modification means (34) includes a logical function selection input (39) connected to said decoder circuit (27) as well as a network of logical circuits (38*a* to 38*e*) for executing the logical functions on the binary values which are applied to it on its two inputs in the course of execution of a modification function.

20. A system according to claim 17 characterized in that said video display processor (4) further includes a control register (24), a status register (30), and at least one buffer register (31*a*, 31*b*) all connected to said data bus (12*a*) of said central processing unit (1) and wherein said buffer register (31*a*, 31*b*) is connected to said arithmetic and logical unit (32) so that the latter can effect the logical operations on a current address and a preceding address stored in the registers (PX or PY) of said register stack (33).

21. A system according to claim 14 characterized in that said mask register (23) is connected to said time sharing control circuit (20) which is adapted to count down the number which is contained in this register, at each accomplished cycle for repetition, or analogous composition function and wherein said mask register (23) is also connected to said decoder circuit (27), for cancelling said enabling signals (28) at the outputs of decoder circuit (27) when the contents of said mask register (23) reach zero.

* * * * *